US005571239A

United States Patent [19]

Kameda et al.

[11] Patent Number: 5,571,239

[45] Date of Patent: Nov. 5, 1996

[54] NOISE CONTROL APPARATUS FOR INTERNAL COMBUSTION ENGINE

[75] Inventors: Yasutoshi Kameda, Anjo; Yoshitaka Nishio, Nagoya; Katsuyuki Tanaka, Nishio; Naoya Kato, Ama-gun; Kouzi Ohara, Nukata-gun, all of Japan

[73] Assignee: Nippondenso Co., Ltd., Kariya, Japan

[21] Appl. No.: 559,092

[22] Filed: Nov. 16, 1995

[30] Foreign Application Priority Data

Nov. 30, 1994 [JP] Japan ..... 6-297383

[51] Int. Cl.[6] ..... F02M 35/10

[52] U.S. Cl. ..... 123/184.53; 123/184.21

[58] Field of Search ..... 123/184.53, 184.21

[56] References Cited

U.S. PATENT DOCUMENTS

| | | | |
|---|---|---|---|
| 4,506,380 | 3/1985 | Matsui | 381/71 |
| 4,805,733 | 2/1989 | Kato et al. | 181/206 |
| 5,053,598 | 11/1991 | Geddes | 381/71 |
| 5,146,505 | 9/1992 | Pfaff et al. | 381/71 |
| 5,176,114 | 1/1993 | Brackett | 123/184.42 |
| 5,485,523 | 1/1996 | Tamamura et al. | 381/71 |

*Primary Examiner*—David A. Okonsky
*Attorney, Agent, or Firm*—Cushman, Darby & Cushman

[57] ABSTRACT

A noise control apparatus has a thermal-type air flow meter for detecting engine load, an engine speed sensor for detecting engine speed, and an intake temperature sensor for detecting intake temperature. The engine load is detected based on the surging components of the signal from the air flow meter. An intake pipe is provided with a speaker that produces a noise control wave in accordance with a control signal from a controller. The controller has a memory that stores map data for noise control waves that are equal in sound pressure but opposite in phase with respect to intake noise. The map data regarding sound pressure and phase correspond to the engine load and speed on the basis of a reference temperature. A CPU of the controller computes a map-reading engine speed value based on a wavelength of intake noise that is determined based on intake temperature and engine speed, such that the map-reading engine speed value provides at the reference temperature substantially the same wavelength as that of the intake noise. The CPU generates a noise control wave signal based on the map-reading engine speed value and engine load information.

10 Claims, 9 Drawing Sheets

FIG. 4A

SOUND PRESSURE

| SPEED / LOAD | ... | 3000 | ... | ... |
|---|---|---|---|---|
| 100 | ... | 95 | ... | ... |
| 90 | ... | 88 | ... | ... |
| ... | ... | ... | ... | ... |
| ... | ... | ... | ... | ... |

FIG. 4B

PHASE

| SPEED / LOAD | ... | 3000 | ... | ... |
|---|---|---|---|---|
| 100 | ... | 350 | ... | ... |
| 90 | ... | 140 | ... | ... |
| ... | ... | ... | ... | ... |
| ... | ... | ... | ... | ... |

NOISE CONTROL APPARATUS FOR INTERNAL COMBUSTION ENGINE

CROSS REFERENCE TO RELATED APPLICATION

This application is based on and claims priority of Japanese Patent Application No. 6-297383 filed on Nov. 31, 1994, the content of which is incorporated herein by reference.

BACKGROUND OF THE INVENTION

1. Field of the Invention

The present invention relates to a noise control apparatus for an internal combustion engine and, more particularly, to a noise control apparatus for obtaining a desirable characteristic of sound including noise elimination by producing a noise control wave that interferes with noise (engine intake and/or exhaust noise) generated by the operation of the engine.

2. Description of the Related Art

To reduce noise, for example, intake noise generated by the intake system of an internal combustion engine, a noise eliminator, such as a resonator, is conventionally disposed in an intake duct. However, to meet the today's growing demand for quietness, a plurality of resonators of increased size are required, taking up an increased installation space in an engine compartment or a vehicle body structure. Moreover, the noise reducing effect of such a conventional system is not sufficient despite the increased number and size of resonators.

Recently, employment of an open control system which uses pre-stored map data regarding phase and sound pressure has been proposed for a noise control apparatus, wherein based on the map data, an actuator (speaker) is caused to produce a noise-control wave for interference with intake noise However, the intake noise reduction rate achieved by such conventional noise control apparatuses undesirably varies with changes in the operational conditions of an internal combustion engine and maximum noise reduction cannot be attained. More specifically, the conventional noise control apparatuses are unable to produce, over a wide rage of the engine operational conditions, an optimal noise control wave that is equal in sound pressure level but opposite in phase, i.e., shifted by 180 degrees, with respect to instant intake noise, which depends on various engine operational conditions. The conventional apparatuses determine a noise control wave to be produced, based on the engine speed and load. However, the sound pressure level of intake noise varies with changes in the intake air temperature even when the engine speed remains unchanged, as shown in FIG. 13, which shows sound level-engine speed curves at two different intake air temperatures of 16 and 32 degrees Celsius. The phase of intake noise also varies with changes in the intake air temperature even when the engine speed remains constant. Thus, the conventional noise control apparatuses fail to produce the optimal noise control waves and accordingly fail to achieve largest-possible noise reduction when the intake air temperature changes.

SUMMARY OF THE INVENTION

The present invention is intended to solve the above stated problems of the conventional art and it is an object of the present invention to provide a noise control apparatus for an internal combustion engine that achieves optimal noise characteristics, such as a fully reduced noise level, despite changes in the engine operational conditions.

According to the present invention, there is provided a noise control apparatus for an internal combustion engine, comprising an engine load detector M1, an engine speed detector M2, a temperature detector M3 for detecting a temperature in the intake or exhaust system, a control signal generator M4 and a control wave actuator M5, as illustrated in FIG. 14. The control signal generator M4 generates a control signal corresponding to a wave that is equal in sound pressure but exactly opposite in phase, that is, shifted by 180 degrees, with respect to noise generated by the intake or exhaust system, based on engine load information from the engine load detector M1, engine speed information from the engine speed detector M2, and an intake air or exhaust gas temperature detected by the temperature detector M3. The control wave actuator M5 receives the control signal from the control signal generator M4 and produces a noise control wave corresponding to the control signal. The thus-produced noise control wave interferes with the intake or exhaust noise to perform noise control, for example, noise elimination.

Since the noise control apparatus of the invention prepares data regarding sound pressure and phase for producing the control wave, on the basis of not only the engine speed and load but also the intake air temperature, which changes the sound pressure level and phase of intake noise as mentioned above, the apparatus precisely and effectively reduces or eliminates the intake noise. The noise control apparatus can perform noise control of exhaust noise in substantially the same manner.

Preferably, the control signal generator M4 has a map M41, a map-reading engine speed value calculator M42, and a map data reader M43, as illustrated in FIG. 15. The map M41 has data regarding phase and sound pressure for a noise control wave that is exactly opposite in phase but equal in sound pressure level with respect to noise. The data arranged in the map M41 are in correspondence with the engine speed and load on the basis of a predetermined reference temperature. The map-reading engine speed value calculator M42 modifies the engine speed data from the engine speed detector M2 to a map-reading engine speed value for reading out from the map M41 the reference temperature-based data for a control wave having the same wavelength as that of instant noise that is determined by the intake air or exhaust gas temperature detected by the temperature detector M3 and the engine speed detected by the engine speed detector M2. The map data reader M43 reads from the map M41 data for providing the control wave, corresponding to the map-reading engine speed value and the engine load information from the engine load detector M1.

The intake or exhaust system of an internal combustion engine can be considered as a single tube structure. Accordingly, the wavelength of noise (intake or exhaust noise) determines the characteristics of the sound pressure and phase of noise. The wavelength of noise is determined by the intake air or exhaust gas temperature if the engine speed is constant. More specifically, as the intake air temperature rises, the wavelength of noise increases along with an increased acoustic velocity. Thus, different noise wavelengths require different data regarding the sound pressure level and phase for noise control waves, for the maximum noise reduction. If the noise wavelength increases, the engine speed used for reading from the reference temperature-based map the sound pressure and phase data for an optimal control wave (for, e.g., the maximum noise reduction) becomes less than the actually detected instant engine speed.

Since the noise control apparatus of the invention determines a map-reading engine speed value for reading out reference temperature-based data regarding sound pressure and phase that provide for the noise control wave having the same wavelength as that of instant noise, and produces such control wave based on the data read from the map, the apparatus achieves optimal noise control for maximum noise reduction. The noise control is performed in substantially the same manner for both intake noise and exhaust noise.

Alternatively, the map M41 of the control signal generator M4 may store data regarding phase and sound pressure for the control wave that is exactly opposite in phase but equal in sound pressure level with respect to noise, the data being in correspondence to noise wavelengths and engine loads on the basis of a predetermined reference temperature. In this case, the control signal generator M4 has a wavelength estimation device M42' for estimating the wavelength of instant noise on the basis of the intake air or exhaust gas temperature detected by the temperature detector M3 and the engine speed detected by the engine speed detector M2. The map data reader M43 reads from the map M41 control wave data corresponding to the wavelength value estimated by the wavelength estimation device M42' and the engine load detected by the engine load detector M1.

The noise control apparatus of the above-described construction produces the noise control wave based on pressure level and phase data corresponding to the wavelength of the present intake or exhaust noise to achieve precise noise control.

It is also preferred to perform correction based on the installation location of the control wave actuator M5 in the intake or exhaust system. The need to weight the control wave data with a temperature factor depends on the distance between the control wave actuator M5 and the noise source (that is, the engine). In general, as this distance increases, the need for the above-described weighting processing becomes more significant. Thus, the correction based on the installation location of the control wave actuator M5 further improves precision in noise control.

More preferably, the noise control apparatus further comprises a pressure detector for detecting the intake or exhaust pressure in the noise propagating path, and a data correction device for performing correction regarding the amount of noise reduction and the amount of delay in phase provided by the control wave actuator M5, on the basis of the pressure detected by the pressure detector. The wave produced by the actuator M5 typically reduces in sound pressure and delays in phase, as the negative intake pipe pressure becomes greater, that is, further away from atmospheric pressure, and as the positive exhaust pressure becomes greater, that is, further away from the atmospheric pressure. Thus, correction of the data for noise control waves in accordance with the amount of noise reduction and/or the amount of delay in phase will help achieve highly precise noise control.

BRIEF DESCRIPTION OF THE DRAWINGS

Further objects, features and advantages of the present invention will become more apparent from the following description of the preferred embodiments with reference to the attached drawings, wherein:

FIGS. 4A and 4B illustrate maps having control wave data;

DETAILED DESCRIPTION OF THE PREFERRED EMBODIMENT

Preferred embodiments of the present invention will be described hereinafter with reference to the accompanying drawings.

(First Embodiment)

Figure 1:
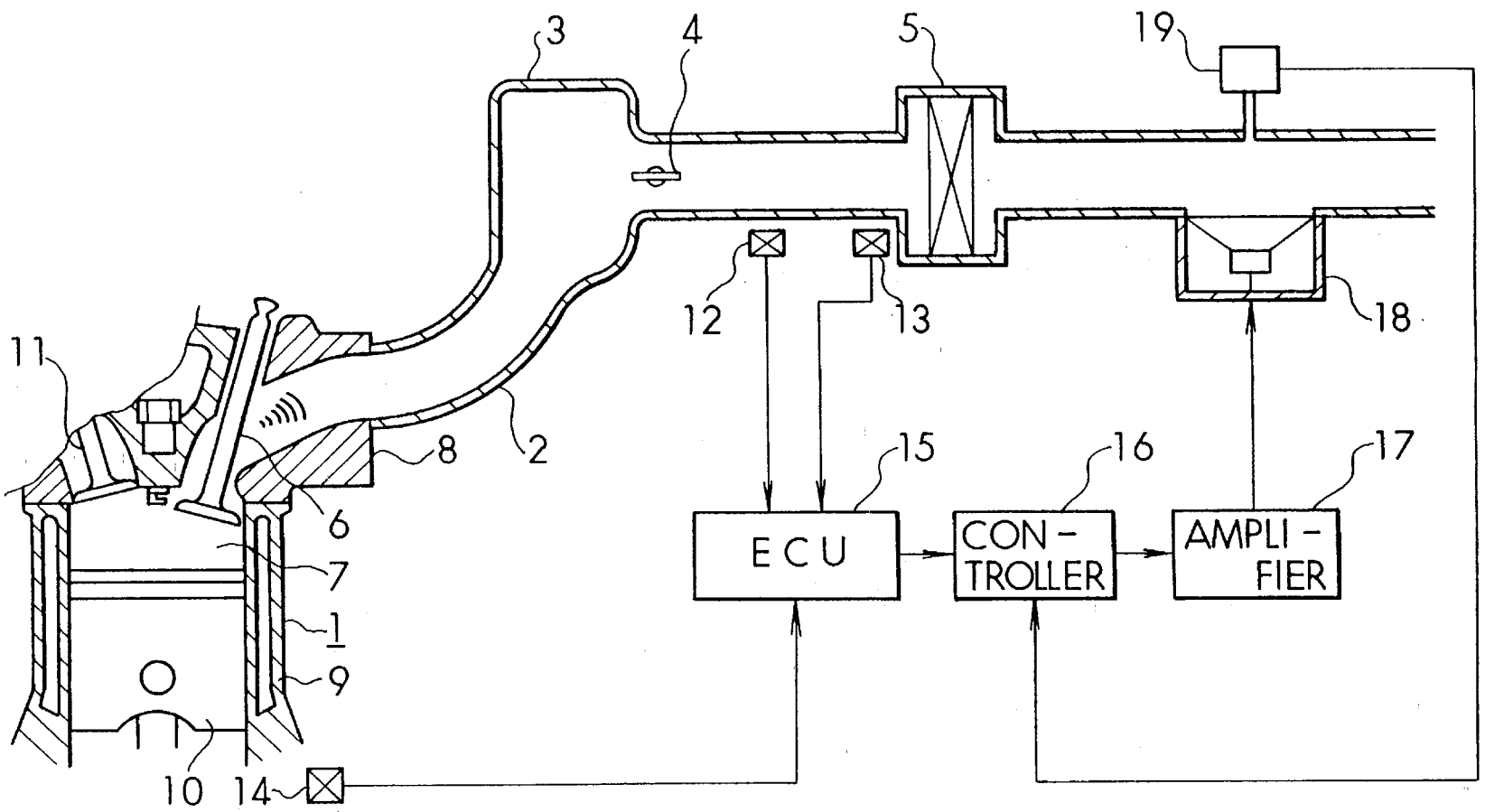
FIG. 1 is a diagram of the overall construction of a preferred embodiment of a noise control apparatus according to the present invention.

FIG. 1 illustrates an intake noise control apparatus for a spark ignition four-cylinder gasoline engine (internal combustion engine) according to a first embodiment. An engine body 1 is connected to an intake pipe 2 which has a surge tank 3. Provided upstream from the surge tank 3 is a throttle valve 4 that is operable by using an accelerator pedal (not shown). An air cleaner 5 is provided upstream from the throttle valve 4.

Intake air through the intake pipe 2 is led into a combustion chamber 7 via an intake valve 6. The combustion chamber 7 is defined by a cylinder head 8, a cylinder block 9 and a piston 10. Burnt gas is discharged to an exhaust pipe (not shown) via an exhaust valve 11.

Disposed upstream from the throttle valve 4 is a thermal-type air flow meter 12 for detecting the amount of air taken into the intake pipe 2. An intake air temperature sensor 13 is provided near the air cleaner 5 for detecting the temperature of intake air. An engine speed sensor 14 is contained in a distributor (not shown). Detection signals from these sensors 12, 13, 14 are inputted into an electronic control unit for engine control (hereinafter, refereed to as "engine control ECU") 15.

The engine control ECU 15 computes an engine load based on the output signal from the thermal-type air flow meter 12. More specifically, the signal from the thermal-type air flow meter 12 is composed of direct current components and alternating current components that overlap the direct current components and are proportional to intake air surge. Main components of the alternating current components correspond to changes of the sound pressure of intake noise. Thus, engine load information can be obtained by extracting alternating current components from the output signal of the thermal-type air flow meter 12 by using a band pass filter (not shown), and by full-wave rectifying and then smoothing the signal for a mean value. The engine control ECU 15 also computes the intake air temperature based on the detection signal from the intake air temperature sensor 13 and further computes the engine speed based on the detection signal from the engine speed sensor 14. Based on the computation results, the engine control ECU 15 performs fuel injection control, ignition timing control, and the like.

A speaker 18, that is, an acoustic wave actuator, is provided upstream from the air cleaner 5 in the intake pipe 2, which serves as the propagating path of intake noise. The speaker 18 is connected to an amplifier 17 by a signal line. The amplifier 17 is connected to a controller 16 that is connected to the engine control ECU 15 also by a signal line. An intake pipe pressure sensor 19 is provided near the speaker 18 for detecting the pressure inside the intake pipe 2 near the speaker 18. Based on a detection signal from the intake pipe pressure sensor 19, the controller 16 computes intake pipe pressure data. The controller 16 also computes control wave data for interference with intake noise, based on the intake pipe pressure data and various data regarding engine operational conditions (engine load, engine speed, and intake air temperature) from the engine control ECU 15.

Figure 2:
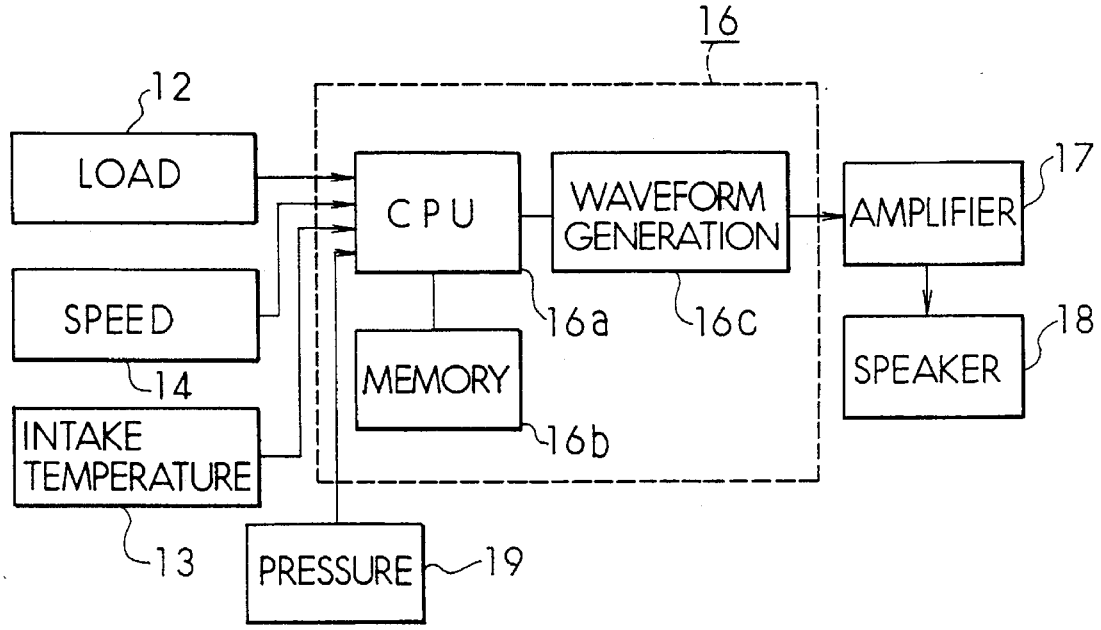
FIG. 2 is a block diagram of the electrical construction of the noise control apparatus.
Figure 3:
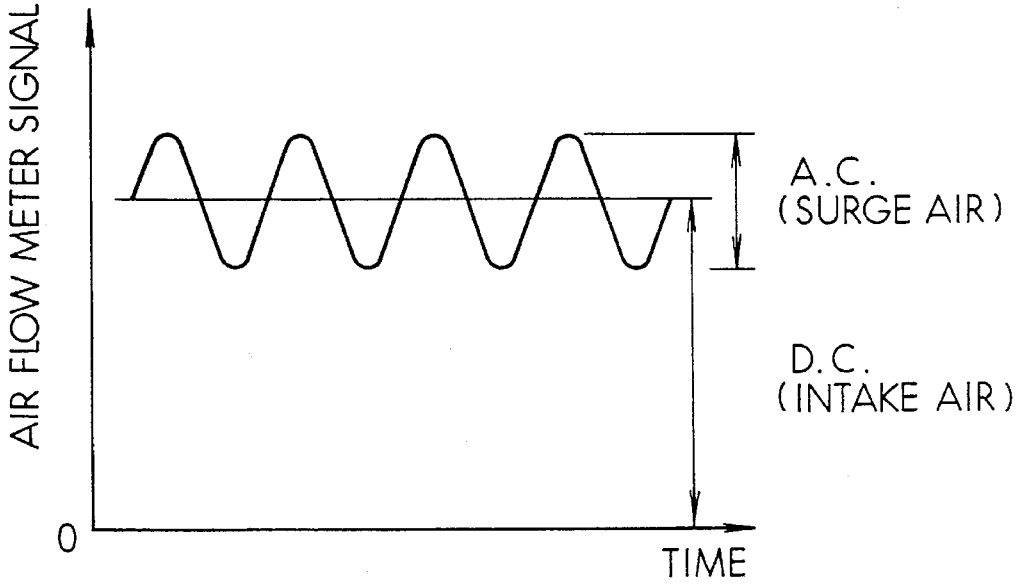
FIG. 3 indicates the waveform of an air flow meter signal.

FIG. 2 is a block diagram of the intake noise control apparatus. Referring to FIG. 2, the controller 16 comprises a central processing unit (hereinafter, referred to as "CPU") 16*a*, a memory 16b and a waveform generating circuit 16*c*. The CPU 16*a* inputs engine load information (surging components of the signal from the air flow meter 12), engine speed information and intake air temperature information. The CPU 16*a* is connected to the memory 16*b* and to the waveform generating circuit 16*c*. The waveform generating circuit 16c is connected to the amplifier 17.

The memory 16*b* stores maps carrying information regarding sound pressure and phase as indicated in FIGS. 4A and 4B, respectively. The maps contain data regarding the phase and sound pressure for noise control waves, in relation to the factors of engine speed and engine load at a predetermined reference temperature T0 (e.g., 20 degrees Celsius). Typically, the noise control waves are equal in sound pressure but exactly opposite in phase, that is, shifted by 180 degrees in phase, with respect to intake noise. The map data regarding phase and sound pressure are prepared through experiments and the like, beforehand. More specifically, the phase and the sound pressure of intake noise are measured, and the measurements are used to obtain theoretically optimal noise control wave data (i.e., phase and sound pressure data) for forming noise control waves that are expected to achieve maximum noise reduction when produced by the speaker 18. The waveform generating circuit 16*c* generates a waveform that has been adjusted in phase and sound pressure.

According to this embodiment, the thermal-type air flow meter 12 constitutes an engine load detector; the intake air temperature sensor 13 constitutes a temperature detector; and the engine speed sensor 14 constitutes an engine speed detector. In addition, the controller 16 constitutes a control signal generator. The CPU 16*a* of the controller 16 constitutes a map-reading engine speed value calculator, a map data reader and a data corrector. The intake pipe pressure sensor 19 constitutes a pressure detector.

The basic theory of the temperature-based correction of control wave data from the map will now be described.

Figure 5:
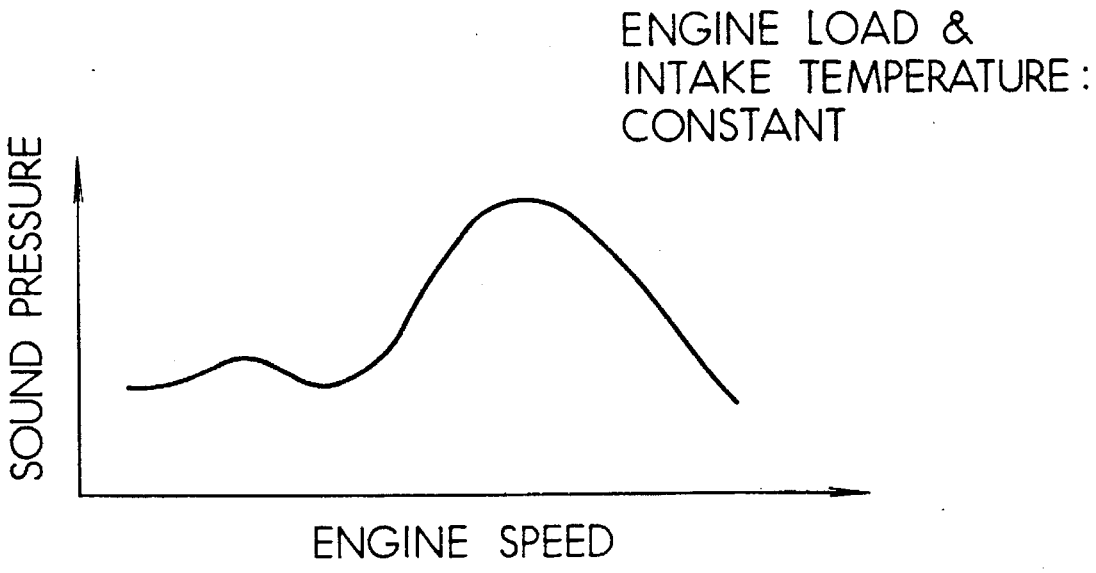
FIG. 5 is a graph indicating the relation between the engine speed and the sound pressure level of noise.
Figure 6:
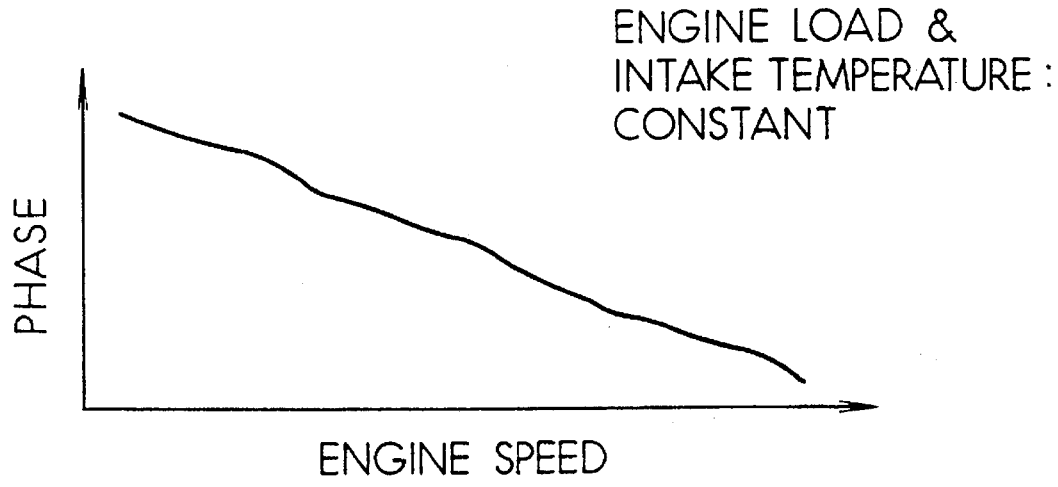
FIG. 6 is a graph indicating the relation between the engine speed and the phase of noise.

FIG. 5 indicates the relation between the engine speed and the sound pressure level of noise when the temperature and the load are constant. FIG. 6 indicates the relation between the engine speed and the phase of noise when the temperature and the load are constant. It is understood from the graphs of FIGS. 5 and 6 that the sound pressure and the phase of noise are determined by the engine speed if the intake air temperature is constant, as corresponding to the data stored in the maps shown in FIGS. 4A and 4B.

Figure 7:
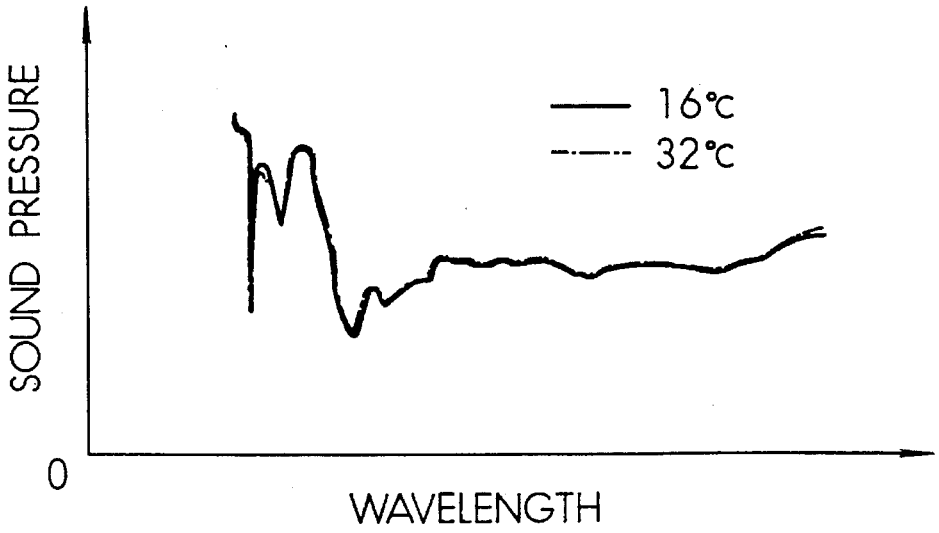
FIG. 7 is a graph indicating the relations between the wavelength and the sound pressure level at two different intake air temperatures.

The engine intake system can be considered as a single tube structure. Accordingly, the sound pressure and the phase of noise are determined by wavelength of intake noise. The relations between the sound pressure and the wavelength of intake noise and between the phase of intake noise and the wavelength of intake noise are substantially independent of intake temperature. As indicated in the graph of FIG. 7, which is based on the fourth-order or quaternary component of intake noise, different temperatures (16 and 32 degrees Celsius in the graph) do not cause much difference in the relation between the sound pressure and the wavelength of noise.

On the other hand, if the engine speed is constant, the wavelength of intake noise depends on the intake air temperature. More specifically, as the intake air temperature rises from T0 to T1, the wavelength of intake noise increases along with increases in acoustic velocity. When the wavelength of noise changes, the data regarding the sound pressure and phase for the noise control wave must be changed to achieve the maximum noise reduction This will be further explained in detail First, the relation between acoustic velocity C1 and intake air temperature T1 is expressed by formula 1.

$$C1 = 331.6 * \frac{\sqrt{(273 + T1)}}{\sqrt{273}} \text{ (m/s)} \qquad \text{Formula 1:}$$

If engine speed R1 is constant, then intake noise frequency f1 is also constant Thus, the frequency f1 of the quaternary component of intake noise is expressed by formula 2.

$$f1 = \frac{R1 * 4}{60} \text{ (Hz)} \qquad \text{Formula 2:}$$

Since intake noise wavelength λ1=C1/f1, the wavelength λl can be expressed by formula 3.

$$\lambda 1 = \frac{60 * 331.6}{R1 * 4} * \frac{\sqrt{(273 + T1)}}{\sqrt{273}} \text{ (m)} \qquad \text{Formula 3:}$$

where T1 is intake air temperature and R1 is engine speed.

Thus, as the intake air temperature T1 rises, the acoustic velocity C1 increases (formula 1). If the engine speed R1 is constant (that is, the frequency f1 is constant), an increase of the acoustic velocity C1 result in an increase in the wavelength λ1 (λ1=C1/f1, and formula 3). If the intake air temperature T1 is constant, wavelength λ1 is substantially in inverse proportion to the engine speed R1, that is, an increase of the wavelength λl corresponds to a decrease in the engine speed R1 (and the frequency f1).

The intake noise wavelength λ at a reference temperature is expressed by formula 4.

$$\lambda 0 = \frac{60 * 331.6}{R * 4} * \frac{\sqrt{(273 + T0)}}{\sqrt{273}} \text{ (m)} \quad \text{Formula 4:}$$

where T0 is the reference temperature and R is engine speed.

Based on the intake noise wavelength λ1 determined by the current or instant intake air temperature T1 and the current or instant engine speed R1, the engine speed R providing the intake noise wavelength λ1 at the reference intake air temperature TO can be obtained as follows. That is, formulas 3 and 4 are solved for the engine speed R under the condition where λ1=λO, to obtain formula 5.

$$R = \frac{\sqrt{(273 + T0)}}{\sqrt{(273 + T1)}} * R1 \text{ (rpm)} \quad \text{Formula 5:}$$

Figure 8:
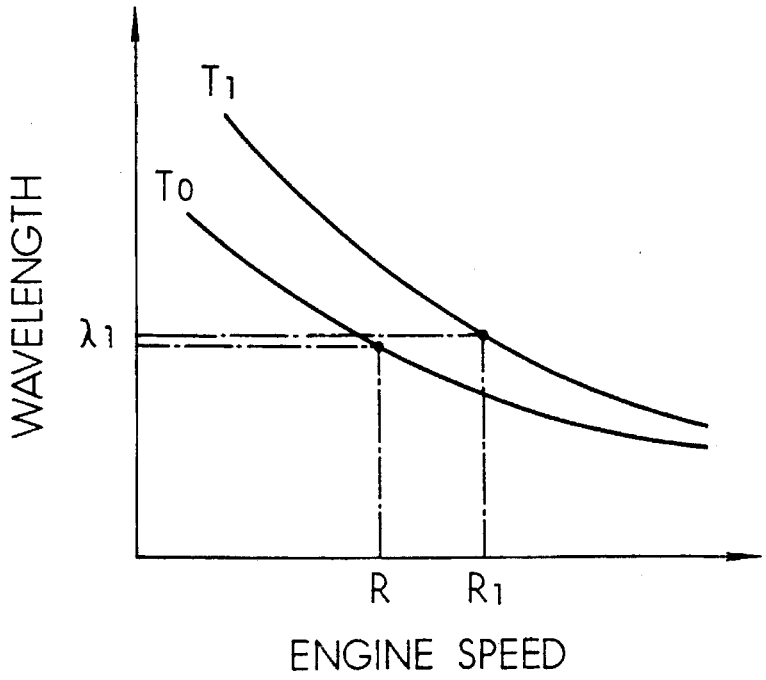
FIG. 8 is a graph indicating the relations between the engine speed and the wavelength at two different intake air temperatures.

The graph of FIG. 8 indicates formulas 3 and 4 and the correspondence between R and R1. The engine speed R obtained by formula 5 serves as a map-reading engine speed value. Data (sound pressure and phase data) in the maps as shown in FIGS. 4A and 4B corresponding to the engine speed R are read out as the optimal control wave data, that is, the control wave data for the maximum noise reduction.

The operation of the noise control device of the above-described construction will be described, with reference to FIG. 9, which shows a flowchart illustrating intake noise control processing repeatedly executed by the CPU 16*a* in a predetermined operational cycle.

In Step 100, the CPU 16*a* inputs engine load information (surging components of the air flow signal), engine speed information (engine speed R1) and intake air temperature information (intake air temperature T1) from the engine control ECU 15. The CPU 16*a* then calculates engine speed R corresponding to the current intake air temperature T1 on the basis of the reference temperature T0 by using formula 5 in Step 110.

The CPU 16*a* reads, in Step 120, required map data (data for an optimal noise control wave that is equal in sound pressure but exactly opposite in phase with respect to the present intake noise) from the maps shown in FIGS. 4A and 4B, according to the engine load information (surging components of the air flow signal) and the engine speed information (the map-reading engine speed value).

Figure 10:
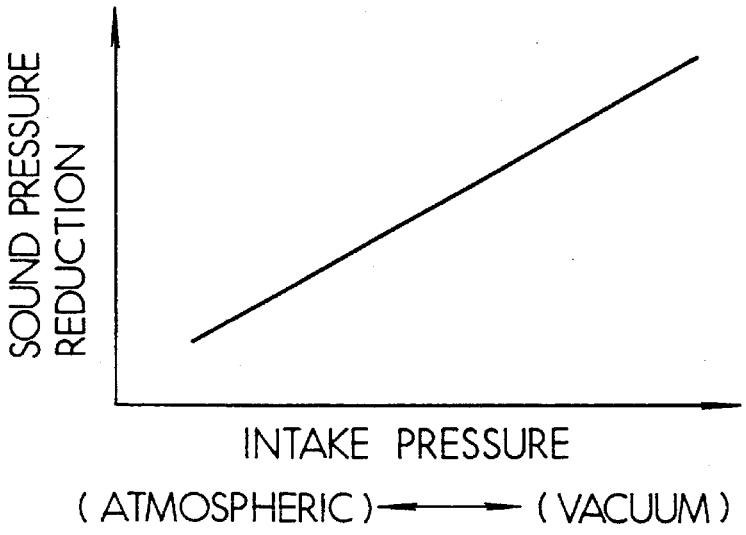
FIG. 10 is a graph indicating the relation between the internal pressure in an intake duct and the amount of noise reduction.
Figure 11:
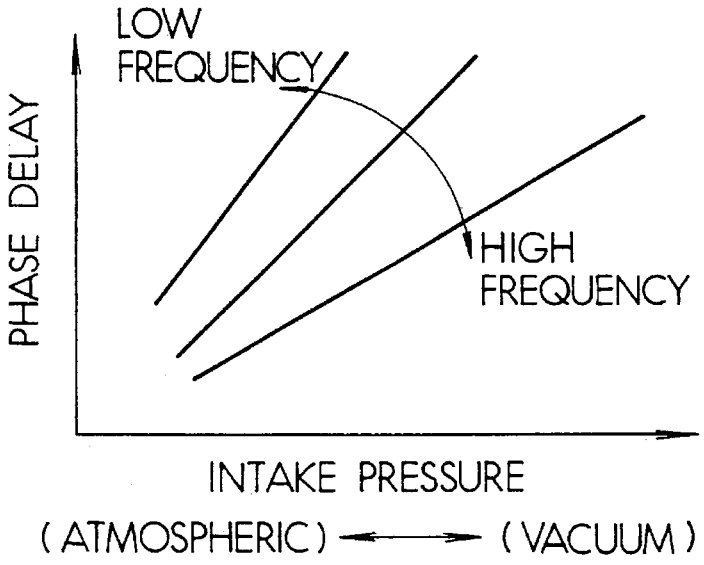
FIG. 11 is a graph indicating the relation between the internal pressure in an intake duct and the amount of delay in the phase of a control wave.

The CPU 16*a* calculates an intake pipe pressure (negative pressure data) using the detection result from the intake pipe pressure sensor 19 in Step 130, and then calculates an amount of sound pressure reduction and an amount of delay in phase according to the current intake pipe pressure in Step 140. The sound pressure of the wave produced by the speaker 18 decreases (that is, the sound pressure reduction of the noise control wave increases) as the negative pressure in the intake pipe 2 increases (that is, the negative pressure further deviates from the atmospheric pressure), as indicated in the graph of FIG. 10. In addition, the phase of the wave from the speaker 18 delays as the negative pressure increases, as indicated in FIG. 11. Thus, the amount of sound pressure reduction and the amount of delay in phase (as indicated in FIGS. 10 and 11) calculated in Step 140 will be used for correction of the sound pressure and phase of the noise control wave.

Using the amount of sound pressure reduction and the amount of delay in phase, the CPU 16*a* corrects in Step 150 the noise control wave data obtained in Step 120. The CPU 16*a* then outputs the corrected noise control wave data to the waveform generating circuit 16*c* in Step 160. The operation thus comes to end.

The waveform generating circuit 16*c* generates a waveform having controlled sound pressure and phase based on the noise control wave data from the CPU 16*a*. The generated waveform is amplified by the amplifier 17 to drive the speaker 18 to produce the noise control wave. The noise control wave interferes with and suppresses the intake noise to achieve noise reduction or elimination.

According to the first embodiment of the invention, the intake noise control apparatus achieves desired noise characteristics, such as maximum noise reduction, even when the engine operational conditions change; for example, when the intake air temperature rises owing to an increase of the engine compartment temperature. In addition, the noise control processing of this embodiment requires map data regarding noise control based on only a single reference intake air temperature, not a plurality of reference intake air temperatures, thus reducing the required storage capacity of the memory 16*b* for storing noise control data. Furthermore, the correction of the data for noise control waves according to the level of intake negative pressure improves the precision in noise characteristic control. A particularly important feature of this embodiment to achieve the above advantages is provided by the combination of: a basic computing construction in which the sound pressure and phase for noise control waves are determined on the basis of the engine speed and load; and an auxiliary computing construction for temperature-based correction in which a factor of intake air temperature is employed together with the reference intake air temperature for determination of the sound pressure and phase for noise control waves.

(Second Embodiment)

An intake noise control apparatus according to a second embodiment will be described. The description concerns generally unique features of the second embodiment.

While the memory 16*b* of the first embodiment stores noise control wave data maps in which data regarding the sound pressure and phase for noise control waves that are equal in sound pressure but exactly opposite in phase with respect to intake noise correspond to engine speed and load on the basis of the reference temperature T0, the memory 16*b* of the second embodiment stores maps in which data regarding the sound pressure and phase for noise control waves correspond to engine loads and intake noise wavelengths on the basis of a predetermined reference temperature T0.

According to this embodiment, the CPU 16*a*, constituting a wavelength estimation device, calculates the wavelength λ1 of intake noise by using formula 6 (the same as formula 3).

$$\lambda 1 = \frac{60 * 331.6}{R1 * 4} * \frac{\sqrt{(273 + T1)}}{\sqrt{273}} \text{ (m)} \quad \text{Formula 6:}$$

The CPU 16*a* reads map data (sound pressure and phase data for a wave control wave) from the memory 16*b* according to the current or instant engine load information and the current or instant wavelength λ1 of intake noise. The map data are outputted as a control signal to the waveform generating circuit 16*c*. Using the signal, the waveform generating circuit 16*c* generates a waveform, which is then transmitted to the speaker 18 via the amplifier 17.

As in the first embodiment, the second embodiment is able to produce a noise control wave that provides the maximum reduction of the current intake noise, thus achieving high precision in noise control.

(Third Embodiment)

Figure 12:
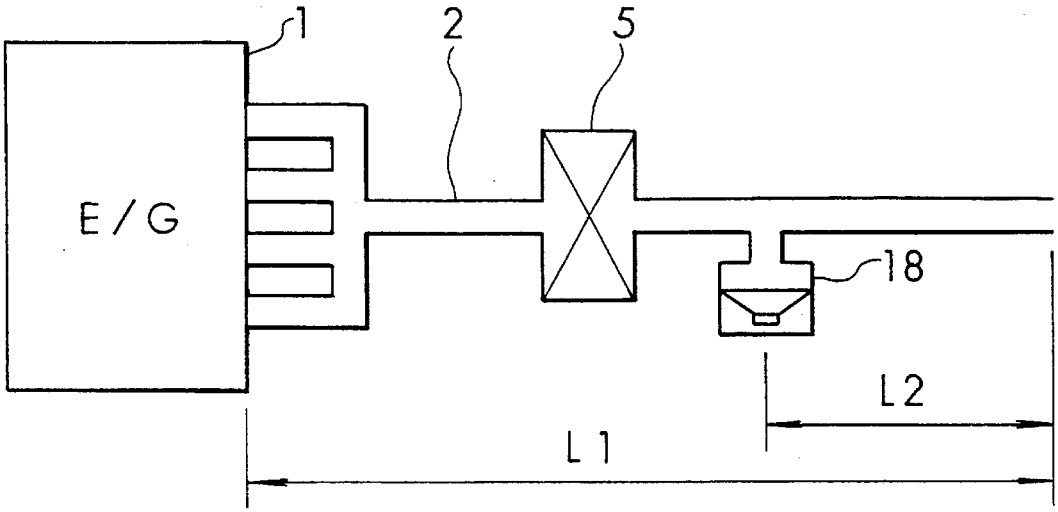
FIG. 12 schematically illustrates the installation location of a speaker.
Figure 13:
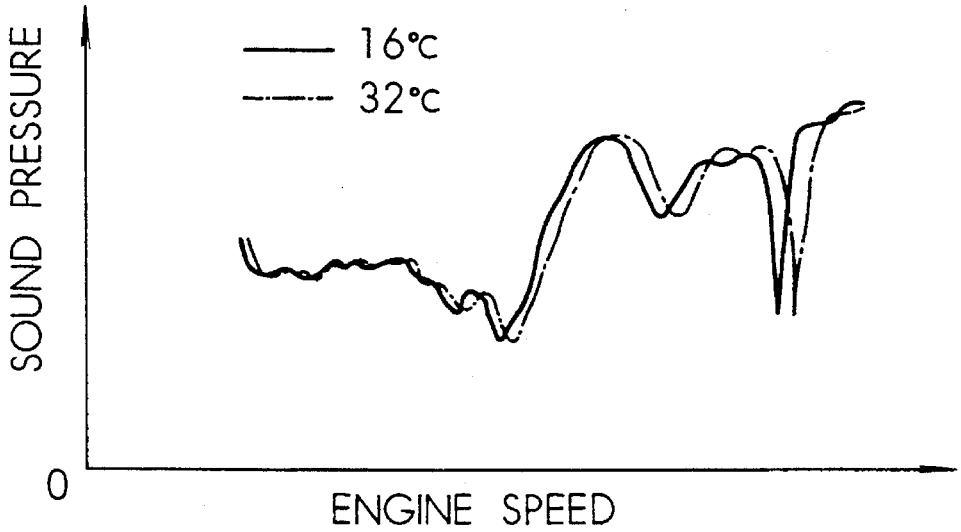
FIG. 13 PRIOR ART
FIG. 13 is graph indicating the relations of the engine speed and the sound pressure level at two different intake pipe pressures.
Figure 14:
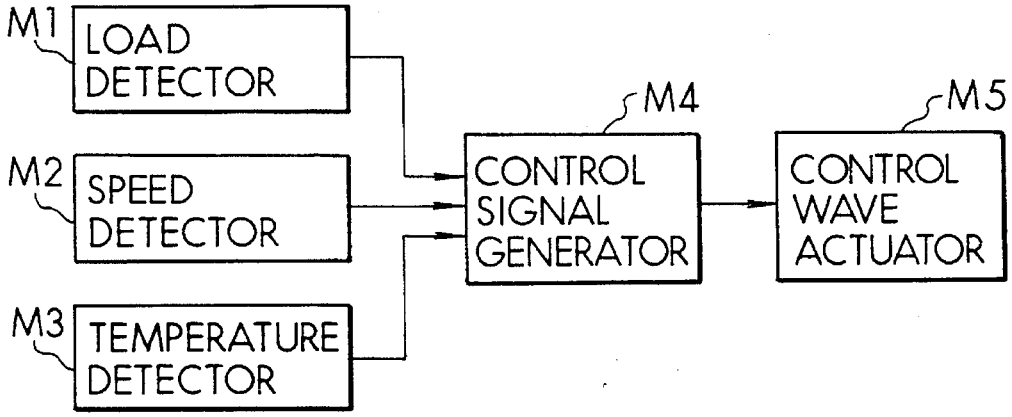
FIG. 14 is a schematic block diagram of a construction according to the invention.
Figure 15:
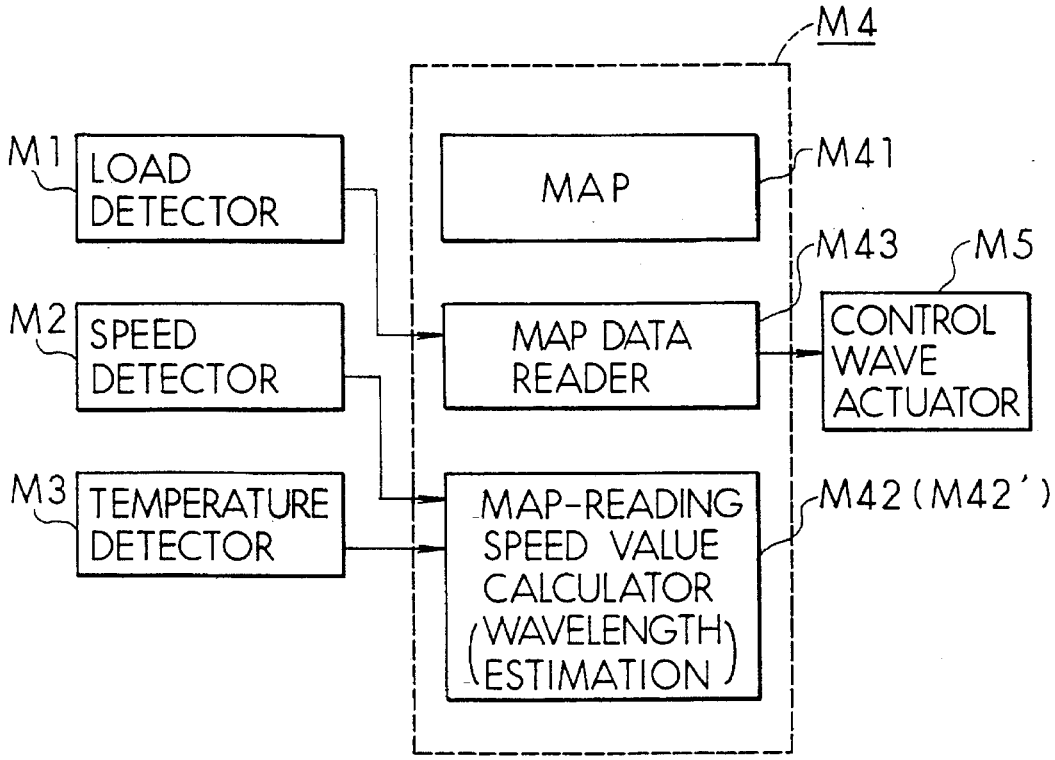
FIG. 15 is another schematic block diagram of a construction according to the invention.

An intake noise control apparatus according to a third embodiment of the invention will be described. According to the third embodiment, installation location of the speaker 18 is carefully considered for optimal noise control. As indicated in the schematic diagram in FIG. 12, a length L1 of the intake pipe 2 is measured between the opening of the intake pipe 2 (the right end in FIG. 12) to the atmosphere and the end adjacent the engine body 1 (the left end in FIG. 12), and a length L2 of the intake pipe 2 is measured between the opening and the speaker 18. Formula 5 can be rewritten into formula 7 by using the pipe lengths L1 and L2.

Formula 7:

$$R=\left\{\frac{\sqrt{(273+T0)}}{\sqrt{(273+T1)}}*(L1-L2)+L2\right\}*\frac{R1}{L1}\ \text{(rpm)}$$

The required amount of temperature-based correction of noise control wave data as described above actually changes according to the pipe length between the speaker 18 and the intake noise source (that is, the engine body 1). Typically, the required correction amount increases as that pipe length increases. Thus, the third embodiment further improves the precision in noise control by employing the factor of location of the speaker 18 in the intake pipe.

(Fourth Embodiment)

The fourth embodiment embodies an exhaust noise control apparatus according to the invention. Although not shown in the drawings, a speaker (that is, a wave actuator) and an exhaust gas temperature sensor (that is, a temperature detector) are provided in the exhaust pipe connected to the engine body 1. The controller 16 computes control data for noise control waves that are equal in sound pressure but exactly opposite in phase with respect to exhaust noise, based on engine load information, engine speed information and exhaust gas temperature information. The speaker 18 then produces a noise control wave based on a noise control signal corresponding to the computed control data. The data and map processing for generation of control data are substantially the same as those in the first, second and third embodiments.

The fourth embodiment achieves desired noise characteristics, such as the maximum noise reduction, even when the engine operation conditions change, as in the first, second and third embodiments.

In addition to the above-described embodiments, the present invention can be embodied in various manners as follows:

(1) Although the above-described embodiments employ the thermal-type air flow meter 12 as the engine load detector wherein the alternating current components of the air flow signal from the air flow meter 12 are used to obtain engine load information, the engine load information can be obtained in other manners. For example, an engine load signal may be obtained based on engine speed and intake air flow. Engine load information can be obtained based on a throttle opening detected by a throttle opening sensor that is provided for detecting the degree of the opening of the throttle valve 4. Furthermore, engine load information may be obtained based on intake pipe pressure detected by an intake pipe pressure sensor that is provided in the surge tank 3 of the intake system for detecting the negative pressure in the intake pipe.

(2) Although according to the first embodiment, the intake pipe pressure sensor 19 is provided near the speaker 18 for detecting the intake pressure, such pressure detection can be achieved in other manners. For example, the intake pressure can be estimated by using the direct current components of the signal from the thermal-type air flow meter 12. Further, a pressure sensor may be provided in the surge tank 3 for outputting a pressure detection signal, based on which the pressure near the speaker 18 can be estimated.

Figure 9:
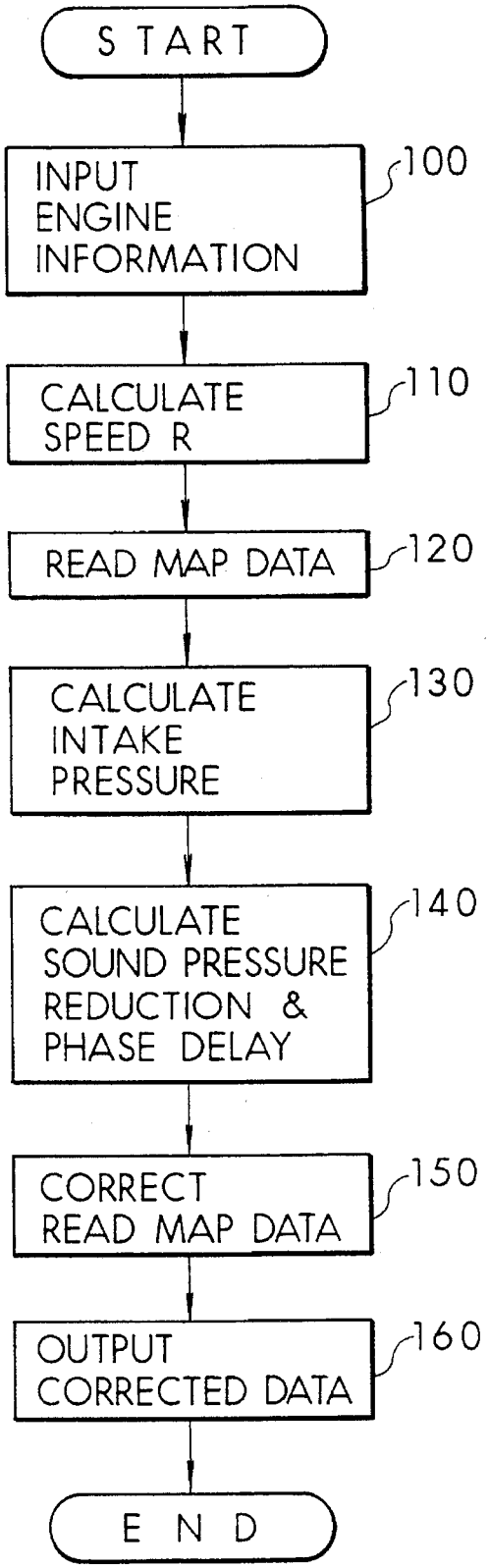
FIG. 9 is a flow chart illustrating intake noise control processing.

(3) The steps 130 to 150 in the flowchart of FIG. 9 in the first embodiment may be omitted.

(4) Although the intake noise control apparatus and the exhaust noise control apparatus are separately embodied according to the first, second and third embodiments and the fourth embodiment, a combined noise control apparatus for controlling both intake and exhaust noises can be provided according to the invention.

While the present invention has been described with reference to what are presently considered to be the preferred embodiments, it is to be understood that the invention is not limited to the disclosed embodiments. Rather, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A noise control apparatus for an internal combustion engine comprising:

engine load detector means for detecting an engine load caused during operation of the engine;

engine speed detector means for detecting an engine speed;

temperature detector means for detecting temperature of at least one of intake air of an intake system and exhaust gas of an exhaust system of the engine;

control signal generator means for generating a control signal corresponding to a control wave that is equal in sound pressure but shifted by substantially 180 degrees in phase with respect to noise produced in at least one of the intake system and the exhaust system, on the basis of engine load information detected by the engine load detector means, engine speed information detected by the engine speed detector means, and temperature of at least one of the intake air and the exhaust gas detected by the temperature detector means; and a wave actuator provided in a propagating path of noise produced by the engine, the wave actuator inputting the control signal from the control signal generator means and producing a noise control wave corresponding to the control signal.

2. The noise control apparatus according to claim 1, wherein the control signal generator means comprises:

a reference temperature-based map having data for the noise control wave that is equal in sound pressure but shifted by substantially 180 degrees in phase with respect to present noise, the data corresponding to engine load and engine speed on the basis of a predetermined reference temperature;

map-reading engine speed calculator means for calculating a map-reading engine speed value on the basis of a wavelength of present noise that is determined based on the temperature of at least one of the intake air and the exhaust gas detected by the temperature detector means and the engine speed detected by the engine speed detector means, such that the map-reading engine speed value corresponds, at the predetermined reference temperature, to substantially the same wavelength as the wavelength of the present noise; and map reader means for reading, from the reference temperature-based map, noise control data corresponding to the map-reading engine speed value calculated by the map-reading engine speed value calculator means and the engine load information detected by the engine load detector means.

3. The noise control apparatus according to claim 1, wherein the control signal generator means comprises:

a reference temperature-based map having data for the noise control wave that is equal in sound pressure but shifted by substantially 180 degrees in phase with respect to present noise, the data corresponding to engine load and engine speed on the basis of a predetermined reference temperature;

wavelength estimation means for estimating a wavelength of the present noise based on the temperature of at least one of the intake air and the exhaust gas detected by the temperature detector means and the engine speed detected by the engine speed detector means; and map reader means for reading, from the reference temperature-based map, noise control data corresponding to the wavelength estimated by the wavelength estimation means and the engine load information detected by the engine load detector means.

4. The noise control apparatus according to claim 1, further comprising:

correction means for performing a correction in accordance with an installation location of the wave actuator in a tubular path structure formed by at least one of the intake system and the exhaust system.

5. The noise control apparatus according to claim 1, further comprising:

pressure detector means for detecting at least one of intake pressure and exhaust pressure in a propagating path of the noise; and data correction means for performing correction in connection with an amount of a sound pressure reduction and an amount of phase delay of the noise control wave produced by the wave actuator.

6. An apparatus for reducing noise produced by a machine having a rotatable member, comprising:

a speaker provided in a propagating path of noise produced by the machine;

a rotation sensor for outputting a rotation signal based on rotational motion performed by the machine; and a control circuit for providing a control signal for the speaker so as to produce a noise control wave that cancels noise produced by the machine, based on the rotation signal from the rotation sensor, wherein the control circuit includes:

memory means that stores noise control wave data for generating a noise control wave, the data corresponding to the rotation signal from the rotation sensor; and correction means for correcting the control signal for the speaker in accordance with temperature of at least one of air and gas in the propagating path of noise.

7. The apparatus according to claim 6, wherein the correction means includes a temperature sensor for outputting a signal indicating the temperature of air or gas in the propagating path of noise, such that the signal from the temperature sensor provides a basis for correcting the control signal.

8. The apparatus according to claim 7, wherein the memory stores the noise control wave data based on a reference temperature.

9. The apparatus according to claim 8, wherein:

the correction means includes means for converting the signal from the rotation sensor to a data-reading rotation signal based on the signal from the temperature sensor and for outputting the data-reading rotation signal; and the control circuit is constructed to retrieve, from the memory means, the noise control wave data based on the data-reading rotation signal and to generate the control signal based on the noise control wave data retrieved based on the data-reading rotation signal.

10. The apparatus according to claim 7, wherein:

the machine includes an internal combustion engine; and the propagating path of noise includes at least one of an intake passage and an exhaust passage of the internal combustion engine.

* * * * *